US008150049B2

(12) United States Patent
Yoo et al.

(10) Patent No.: US 8,150,049 B2
(45) Date of Patent: Apr. 3, 2012

(54) DIGITAL HEARING AID ADAPTIVE TO STRUCTURES OF HUMAN EXTERNAL EAR CANALS

(75) Inventors: Hoi-Jun Yoo, Daejeon (KR); Sun-Young Kim, Daejeon (KR); Seung-Jin Lee, Daejeon (KR)

(73) Assignee: Korea Advanced Institute of Science and Technology, Daejeon-si (KR)

( * ) Notice: Subject to any disclaimer, the term of this patent is extended or adjusted under 35 U.S.C. 154(b) by 1198 days.

(21) Appl. No.: 11/876,490

(22) Filed: Oct. 22, 2007

(65) Prior Publication Data

US 2008/0273726 A1 Nov. 6, 2008

(30) Foreign Application Priority Data

Oct. 24, 2006 (KR) ..... 10-2006-0103478

(51) Int. Cl.
*H04R 29/00* (2006.01)

(52) U.S. Cl. ..... 381/60; 381/312; 381/314; 381/315; 381/320; 600/25; 607/55; 607/57

(58) Field of Classification Search ..... 381/60, 381/312, 315, 320; 600/25; 607/55, 57
See application file for complete search history.

(56) References Cited

U.S. PATENT DOCUMENTS

2006/0083395 A1* 4/2006 Allen et al. ..... 381/312
2008/0260171 A1* 10/2008 Nordahn et al. ..... 381/60

FOREIGN PATENT DOCUMENTS

WO WO 2005076664 A1 * 8/2005

OTHER PUBLICATIONS

Patricia G. Stelmachowicz, et al., Is functional gain really functional?, The Hearing Journal, Nov. 2002, vol. 55, No. 11.
James M. Kates, A computer simulation of hearing aid response and the effects of ear canal size, J. Acoust. Soc. Am., 83(5), May 1988, pp. 1952-1963.
Susan E. Voss, et al., Measurement of acoustic impedance and reflectance in the human ear canal, J. Acoust. Soc. Am., 95(1), Jan. 1994, pp. 372-384.

* cited by examiner

*Primary Examiner* — Steven Loke
*Assistant Examiner* — Cuong Nguyen
(74) *Attorney, Agent, or Firm* — H.C. Park & Associates, PLC

(57) ABSTRACT

The present invention relates to a digital hearing aid, which models the structures of external ear canals, sizes and shape characteristics of which differ between respective persons, obtains resonance gains generated due to the structural characteristics of the external ear canals, and performs digitization and signal processing to allow the resonance gains to be used as the gain factors of the digital hearing aid, and thus applies the gain factors to digital signal processing units. Further, the present invention proposes a gain obtainment unit capable of taking both resonance gains, generated due to the structural characteristics, and gains, obtained through a hearing test, into account, thus reducing the time required for gain fitting and possible errors, and optimizing the performance of the digital hearing aid for each individual.

10 Claims, 10 Drawing Sheets

DIGITAL HEARING AID ADAPTIVE TO STRUCTURES OF HUMAN EXTERNAL EAR CANALS

This application claims priority from and the benefit of Korean Patent Application No. 10-2006-103478, filed on Oct. 24, 2006, which is hereby incorporated by reference for all purposes as if fully set forth herein.

BACKGROUND OF THE INVENTION

1. Field of the Invention

The present invention relates, in general, to digital hearing aids, and, more particularly, to a digital hearing aid adaptive to the structures of human external ear canals, which models the structures of external ear canals, the sizes and shape characteristics of which differ between respective persons, captures resonance gains occurring due to the structural characteristics thereof, and performs digitization and signal processing on the resonance gains to allow the resonance gains to be used as gain factors, thus optimizing the performance of the digital hearing aid in consideration of personal features.

2. Description of the Related Art

The hearing of sound has a meaning beyond a simple sensory action. When hearing ability is lost, it is impossible to normally perform social activity, and, as a result, feeblemindedness may occur. A hearing aid, which is a tool used to compensate for hearing impairment occurring due to the loss of hearing ability, aims to amplify an acoustic signal, input to the hearing organ of a person who has difficulty in hearing, to thus make the amplitude of the acoustic signal, recognized through the brain, the same as that of a normal person.

Hearing aids, currently being commercialized, can be mainly classified into three types, that is, an analog type, a digital type, and an analog/digital hybrid type.

Analog hearing aids, currently occupying most hearing aid markets, have been greatly developed over the past several decades from the standpoint of functionality, but possible signal processing methods are inevitably limited to basic items in such a way that the audible range is compressed or amplified using a limited number of bands (typically, two or three bands). This is due to problems in that an analog circuit has low flexibility or reliability and in that it is difficult to implement a complicated signal processing method because the adjustment of functions is not facilitated.

Therefore, the necessity for digital hearing aids having a digital circuit therein has existed for a long period of time, and the development of digital signal processing algorithms required for the digital hearing aids has also been continuously conducted.

Digital hearing aids can easily realize a complicated high-performance signal processing algorithm while realizing an advantage in circuit flexibility and reliability, and, in particular, can efficiently implement a high-performance hearing impairment compensation algorithm, such as a non-linear correction method for patients undergoing autoimmune sensorineural hearing loss.

However, typical digital hearing aids do not take inherent resonance gains of personal external ear canals into account during a gain fitting and verification process, but extract and fit gains only through a hearing test, and thus the degree of satisfaction of each individual, obtained through initial fitting, is greatly decreased.

Therefore, continuous post-fitting management is required, and both the time required for gain fitting and gain errors, occurring due to the continuous post-fitting management, greatly differ between respective persons, which becomes a principal factor making gain fitting difficult.

Typical methods of performing post-fitting management are classified into a probe-tube microphone fitting verification method and a functional gain fitting verification method.

However, in the case of the probe-tube microphone fitting verification method, there are problems in that a considerable error occurs in measured gains depending on the location of a probe-tube, and in that, since the motion of each individual is limited at the time of measurement, it is difficult to use this method for children. In the case of the functional gain fitting verification method, there are problems in that reliability is deteriorated at the time of retesting and in that resolution in a frequency domain is deteriorated.

SUMMARY OF THE INVENTION

Accordingly, the present invention has been made keeping in mind the above problems occurring in the prior art, and an object of the present invention is to provide a digital hearing aid, which models the structures of external ear canals, the sizes and shape characteristics of which differ between respective persons, captures resonance gains, occurring due to the structural characteristics thereof, and performs digitization and signal processing on the resonance gains to allow the resonance gains to be used as gain factors, thus optimizing the performance of the digital hearing aid in consideration of personal features.

Another object of the present invention is to provide a digital hearing aid, which performs primary gain insertion and fitting by reducing the time required for gain fitting and possible errors and by optimizing the performance for each individual, through gain factors in which both gains generated due to the structural characteristics of external ear canals and gains obtained through individual hearing tests are taken into account, and then performs secondary gain insertion and fitting using gains, obtained by conducting a hearing test again while a hearing aid is worn, thus further reducing the time required for the gain insertion and fitting of the hearing aid, and realizing gains reflecting the features of different external ear canals of respective persons.

In order to accomplish the above objects, the present invention provides a digital hearing aid, comprising an amplification unit for amplifying an external voice signal, input through a microphone, an Analog/Digital (AD) converter for converting an analog signal, amplified by the amplification unit, into a digital signal, at least one signal processing unit for performing gain fitting and digital signal processing on the digital signal output from the AD converter, a Digital/Analog (DA) converter for converting the digital signal, processed by the signal processing unit, into an analog signal, a receiver driver for outputting the analog signal, output from the DA converter, through a receiver, and a gain obtainment unit for performing gain fitting by utilizing both resonance gains, obtained by an external ear canal modeling circuit implemented according to shape characteristics of structures of external ear canals, and gains, obtained through a hearing test, as gain factors for the signal processing unit.

Preferably, the gain obtainment unit may comprise the external ear canal modeling circuit for modeling the structures of the external ear canals using an LC filter, thus extracting frequency characteristics, an envelope detector for outputting a DC voltage corresponding to frequency characteristics output from the external ear canal modeling circuit, a successive approximation analog/digital converter for modulating the DC voltage, output from the envelope detector, into a digital signal, at least one comparator for generating a control signal required to extract a maximum gain factor at a frequency at which a maximum gain level is obtained, and a gain factor at a specific frequency, from each of output of the successive approximation AD converter and output of the hearing test, and an adder for adding a maximum gain factor, output from the successive approximation analog/digital converter, to a maximum gain factor, obtained through the hearing test, in response to the control signal output through the comparator, and outputting a resulting gain factor to the signal processing units.

Preferably, the external ear canal modeling circuit may be implemented such that one or more fixed taps, each including an inductor and a capacitor, and one or more variable taps, each including a variable inductor and a variable capacitor, are connected in series, thus adjusting inductance and capacitance of each variable tap in response to an external control signal depending on characteristics of the external ear canals.

Preferably, each of the variable taps may comprise four series-connected inductors and four parallel-connected capacitors, which are turned on or off in response to the external control signal, thus enabling a number of inductors and a number of conductors in the variable tap to be adjusted.

Preferably, the external ear canal modeling circuit may be implemented such that resonance gains corresponding to frequencies are resonance gains corresponding to responses for pure tones having frequencies increasing in a range from 1 kHz to 8 kHz at regular intervals of 1 kHz.

Preferably, the successive approximation AD converter may shut off power of a multiplexer and a flip-flop at times at which output bits are not output.

Preferably, the gain obtainment unit may further comprise a first register unit for storing gain factors output from the successive approximation AD converter.

Preferably, the gain obtainment unit may further comprise a second register unit for storing gain factors required to implement a desired gain, obtained through the hearing test.

Preferably, each of the first and second register units may comprise a plurality of 5-bit registers, thus enabling the gain factors to be sequentially shifted and stored therein in response to a clock frequency.

Preferably, gain factors obtained through the hearing test may be gains obtained at frequencies ranging from 1 kHz to 8 kHz.

Preferably, the specific frequency may be a frequency of 4 kHz.

The present invention having the above construction is advantageous in that a modeling circuit for the structures of external ear canals, the sizes and shape characteristics of which differ between respective persons, can be implemented using an LC filter, so that resonance gains corresponding to frequencies are captured, and digitization and signal processing are performed on the resonance gains to allow the resonance gains to be used as gain factors. Accordingly, the time required for gain fitting and possible errors can be reduced, and gains meeting the features of different external ear canals can be obtained for respective persons, and thus the performance of the digital hearing aid can be optimized for each individual.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
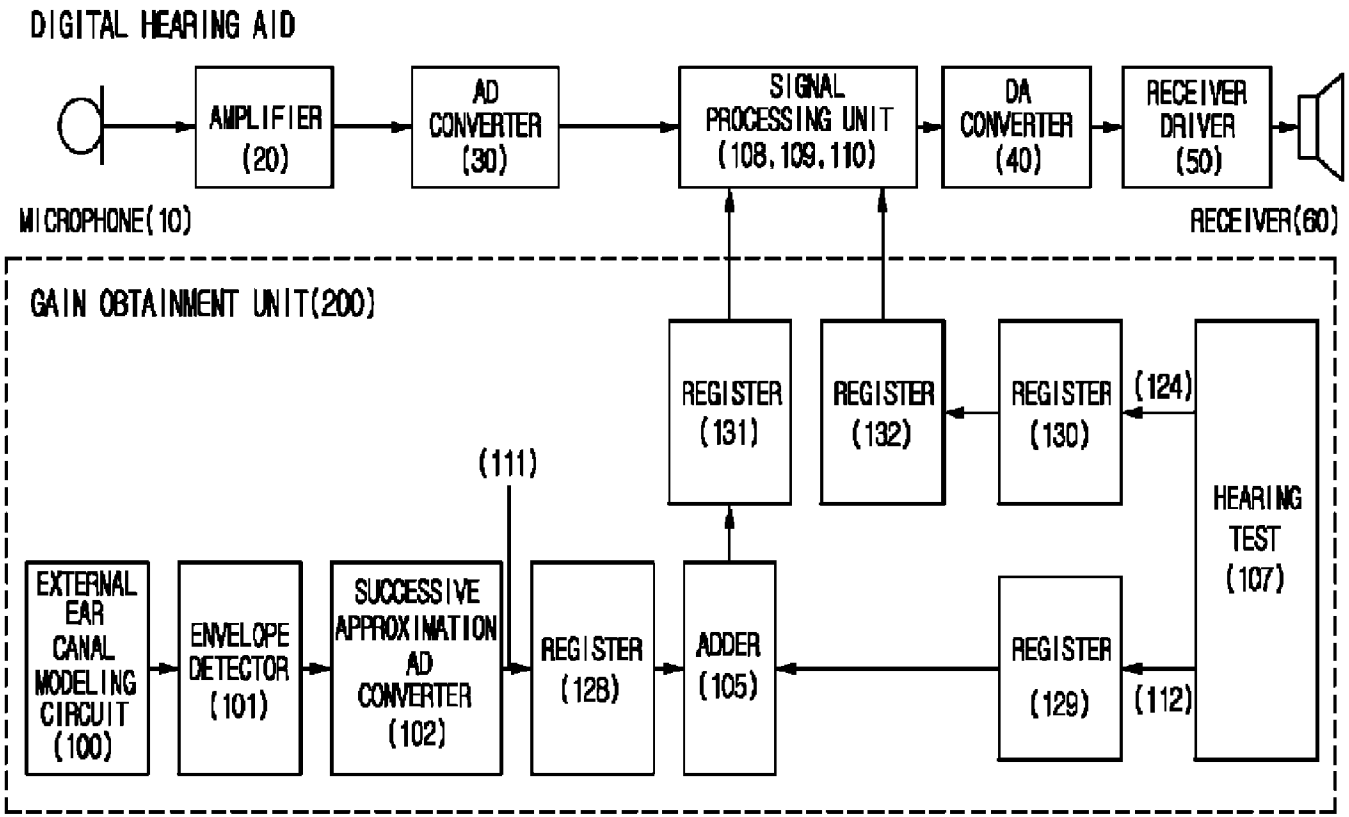
FIG. 1 is a block diagram showing the construction of a digital hearing aid according to the present invention.

Hereinafter, embodiments of the present invention will be described in detail with reference to the attached drawings, and the same reference numerals are used throughout the different drawings to designate the same or similar components. Further, the embodiments are not intended to limit the scope of the present invention, but are intended to exemplify the present invention. Those skilled in the art will appreciate that various modifications are possible.

Figure 2:
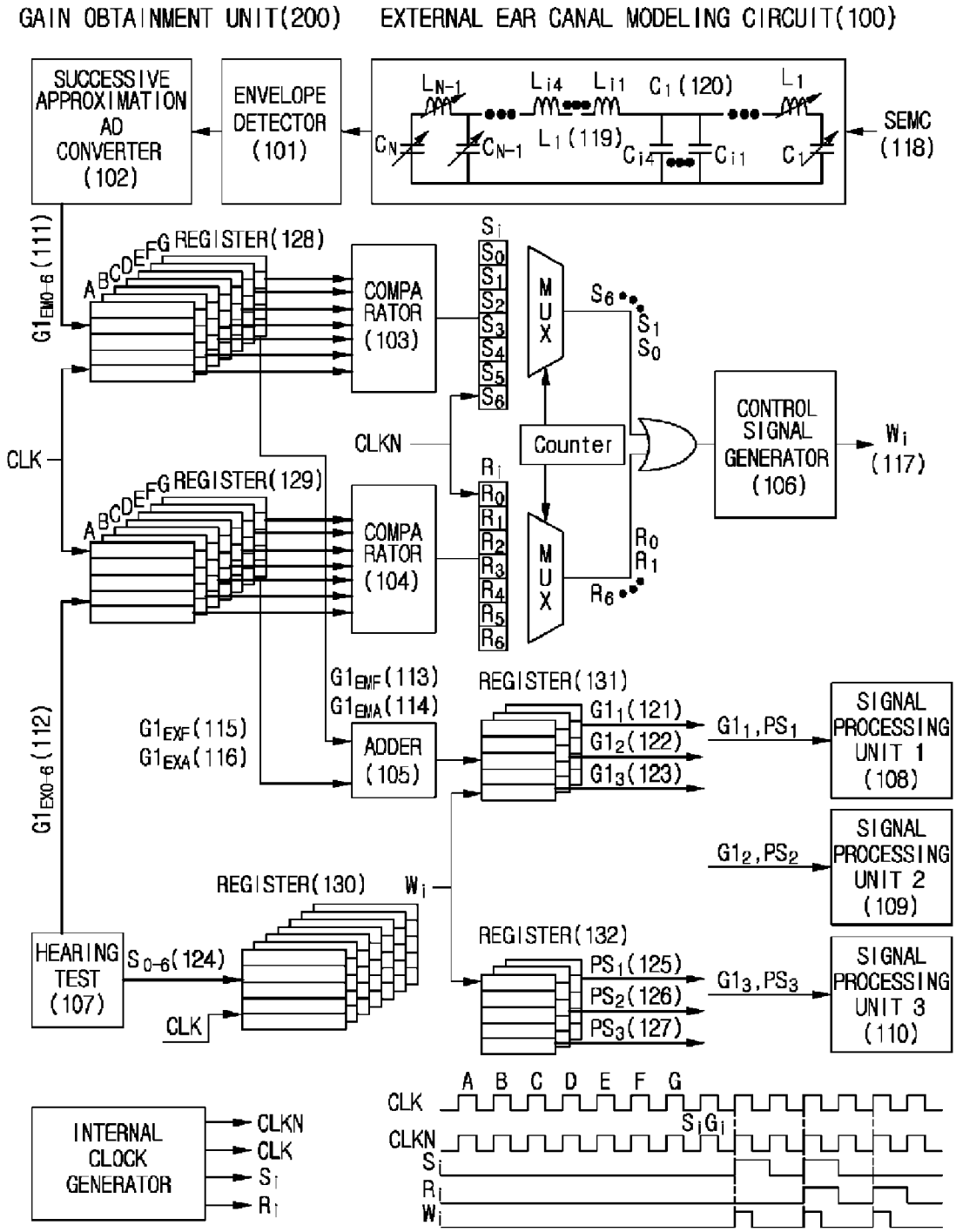
FIG. 2 is a circuit diagram showing the gain obtainment unit of a digital hearing aid according to the present invention.

FIG. 1 is a block diagram showing the construction of a digital hearing aid according to the present invention, and FIG. 2 is a circuit diagram showing the gain obtainment unit of the digital hearing aid according to the present invention.

As shown in FIG. 1, the digital hearing aid includes an amplification unit 20 for amplifying an external voice signal, input through a microphone 10, an Analog/Digital (AD) converter 30 for converting the analog signal, amplified by the amplification unit 20 into a digital signal, signal processing units 108, 109, and 110 for performing gain fitting and digital signal processing on the digital signal output from the AD converter 30, a Digital/Analog (DA) converter 40 for converting the digital signal, processed by the signal processing units 108, 109, and 110, into an analog signal, and a receiver driver 50 for outputting the analog signal, output from the DA converter 40, through a receiver 60, and further includes a gain obtainment unit 200 for performing gain fitting by utilizing both the resonance gains, obtained by an external ear canal modeling circuit 100 implemented according to the shape characteristics of the structures of external ear canals, and the gains, obtained through a hearing test 107, as gain factors for the signal processing units 108, 109 and 110.

As shown in FIG. 2, the gain obtainment unit 200 includes the external ear canal modeling circuit 100 for modeling the structures of external ear canals using an LC filter, thus extracting frequency characteristics, an envelope detector 101 for outputting a DC voltage corresponding to the frequency characteristics output from the external ear canal modeling circuit 100, a successive approximation AD converter 102 for converting the DC voltage output from the envelope detector 101 into a digital signal, comparators 103 and 104 for generating a control signal 117, required to extract the maximum gain factor at a frequency at which the maximum gain level is obtained, and a gain factor at a specific frequency from each of the output of the successive approximation AD converter 102 and the output of the hearing test 107, and an adder 105 for adding the maximum gain factor, output from the successive approximation AD converter 102, to the maximum gain factor, obtained through the hearing test 107, in response to the control signal 117 output through the comparators 103 and 104, and outputting the resulting gain factor to the signal processing units 108, 109, and 110. In detail, the adder 105 adds the gain factor $G1_{EX0\sim6}$ (112), obtained through the hearing test 107, to the gain factor $G1_{EM0\sim6}$ (111), obtained through the external ear canal modeling circuit and the successive approximation AD converter 102, and outputs the resulting gain factor $G1_{0\sim6}$(133) to the signal processing units 108, 109, and 110.

This construction is described in detail. The external ear canal modeling circuit 100 models the structures of external ear canals, the characteristics of which differ between respective persons, using a two-dimensional X-ray picture, in the form of an LC filter, thus extracting resonance gains corresponding to frequencies.

In this case, L and C values must be adjusted to take personal differences in the external ear canal into account, and, for this operation, an 11-bit digital control signal SEMC 118 is used.

According to an embodiment of the present invention, the external ear canal modeling circuit 100 is composed of a total of 30 taps, which are divided into 14 fixed taps and 16 variable taps. This structure can be subsequently expanded to 30 variable taps, and the number of taps can be expanded from 30 to N.

In this case, a single tap is composed of four series-connected inductors 119 and four parallel-connected capacitors 120. Therefore, the number of inductors and the number of capacitors in the variable tap are adjusted using the digital control signal 118, thus enabling the features of the external ear canals of respective persons to be modeled.

Further, the envelope detector 101 captures the frequency response of the external ear canal modeling circuit 100, ranging from 1 kHz to 8 kHz, in steps of 1 kHz, and thus detects the maximum gain values at respective frequencies.

Further, in order for the signal processing units 108, 109, and 110 of the hearing aid to use the detected maximum gain values as gain factors, the digitization and signal processing of the detected maximum gain values are required. Therefore, the detected gains are digitized using the 5-bit low-power successive approximation AD converter 102. The gain factors $G1_{EM}$ (111) obtained at this time include the maximum gain values ranging from 1 kHz to 8 kHz.

However, when the signal processing units 108, 109 and 110 for taking gains at all frequencies ranging from 1 kHz to 8 kHz into account are implemented, power consumption relative to performance is increased, and thus an algorithm capable of obtaining a sufficient gain, required by each individual, while reducing power consumption is required.

Therefore, an algorithm for obtaining only the 4 kHz gain factor $G1_{EMF}$ (113), required to compensate for loss at 4 kHz, generally exhibited by typical hearing-impaired persons, and only the maximum gain factor $G1_{EMA}$ (114), obtained at all frequencies, is implemented through the comparator 103.

The gain factors obtained through the hearing test 107 also include gain values at all frequencies ranging from 1 kHz to 8 kHz. For the same reason as in the above description, the comparator 104 is introduced to select only the gain factor $G1_{EXE}$ (115) at 4 kHz and the maximum gain factor $G1_{EXA}$ (116), obtained at all frequencies, and to determine a frequency having the maximum gain.

The algorithm for selecting a single frequency having the maximum gain from each of the output of the successive approximation AD converter 102 and the output of the hearing test is implemented through the comparators 103 and 104. On the basis of this information, the control signal generator 106 generates a control signal Wi(117), which is used to select the frequency having the maximum gain.

Gain factors $G1_{EM}$(111) and $G1_{EX}$(112) are added to each other by the adder 105, and gains at this time include all gains at the frequencies ranging from 1 kHz to 8 kHz. The maximum gain factors $G1_1$(121) and $G1_2$(122), and the gain factor $G1_3$(123), corresponding to the sum of $G1_{EMF}$(113) and $G1_{EXF}$(115), can be obtained using the control signal Wi (117), output through the comparators 103 and 104.

These three gain factors take charge of gains at three frequencies, and are input to the signal processing units 107, 108, and 109 as gain factors.

Further, gain factors $PS_{0\sim4}$ (124) unrelated to the structures of the external ear canals are obtained from the results of the hearing test 107, and also include gain factors at all frequencies ranging from 1 kHz to 8 kHz. Therefore, only the gain factors $PS_1$(125), $PS_2$(126), and $PS_3$(127) to be used at specific frequencies are applied to the signal processing units 108, 109, and 110 using the control signal Wi(117).

After primary gain insertion and fitting are performed through such a process, a hearing test is conducted, and the difference between the fitted gain and a desired gain is detected, and is applied to the new gain factors $G1_{EXP}$(115) and $G1_{EXA}$(116), thus performing gain fitting.

Through the digital hearing aid implemented in this way, the resonance gains, spontaneously occurring due to the features of different external ear canals of respective persons, are considered in the gain insertion and fitting of the hearing aid, and thus the hearing aid can be optimized for each individual.

Further, the present invention can perform primary gain insertion and fitting by applying gain factors to the signal processing units of the digital hearing aid through the external ear canal modeling circuit, implemented such that the time required for gain insertion and fitting and possible errors can be reduced and such that both the gains generated by structural characteristics and gains obtained through individual hearing tests can be taken into account so as to obtain gains optimized for each individual. Thereafter, the present invention performs secondary gain insertion and fitting by conducting a hearing test again while the hearing aid is worn, and by utilizing the gains obtained through the hearing test. As a result, the present invention can implement a digital hearing aid, which can remarkably decrease the time required for the gain insertion and fitting of the hearing aid, and which can obtain gains suitable for the features of different external ear canals of respective persons.

Figure 3:
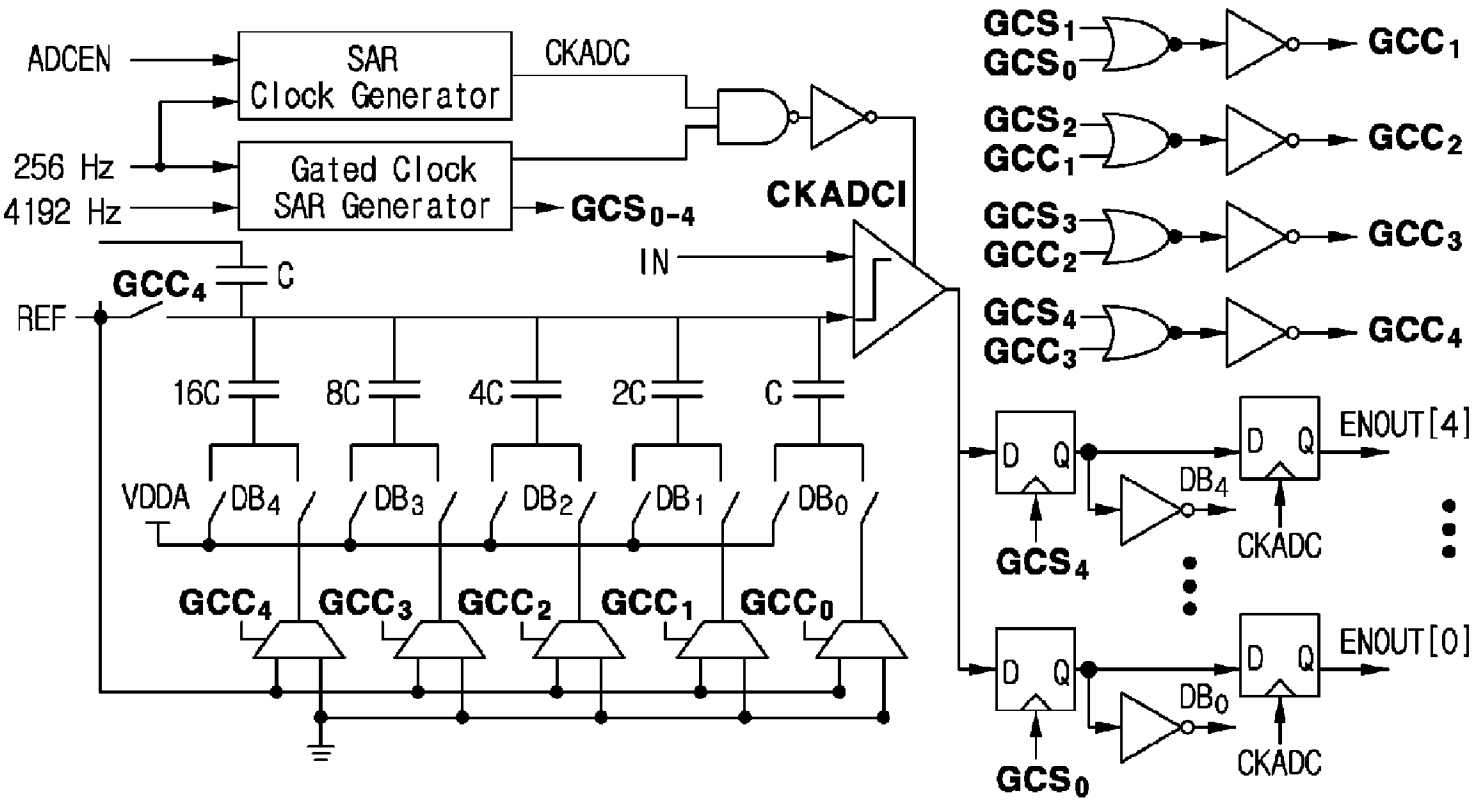
FIG. 3 is a circuit diagram showing the successive approximation analog/digital converter of a digital hearing aid according to the present invention.

FIG. 3 is a circuit diagram showing the successive approximation AD converter of the digital hearing aid according to the present invention.

In this case, in order to reduce the power consumption of the successive approximation AD converter 102, control signals GCC and GCS are generated to shut off the power of multiplexers and flip-flops at the times at which output bits are not output, thus enabling the successive approximation AD converter 102 to be driven at low power.

FIGS. 4A to 4D are graphs showing a gain factor at the maximum gain frequency and a gain factor at 4 kHz, which are obtained using the gain obtainment unit of the digital hearing aid according to the present invention.

Figure 4A:
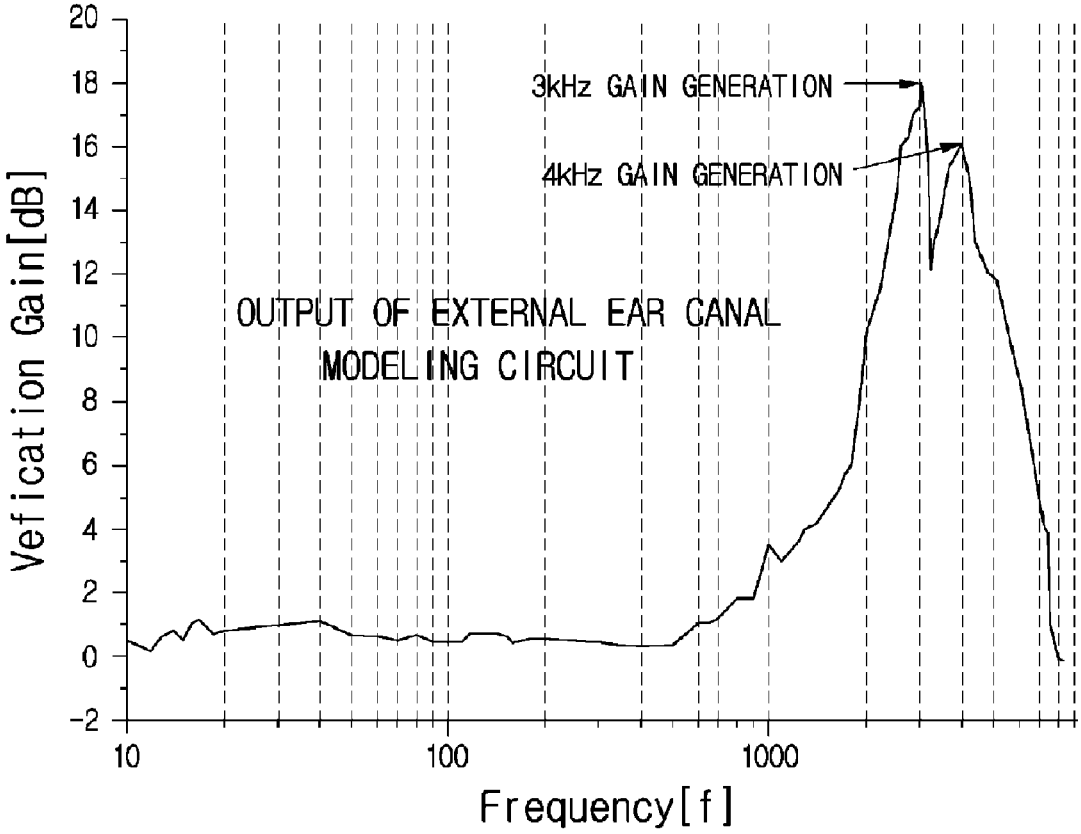
FIGS. 4A to 4D are graphs showing a gain factor at the maximum gain frequency and at a frequency of 4 kHz, which are obtained using the gain obtainment unit of a digital hearing aid according to the present invention.

FIG. 4A is a graph showing the output of the external ear canal modeling circuit 100, measured in the frequency domain. It can be observed that gains are generated at frequencies of 3 kHz and 4 kHz.

Figure 4B:
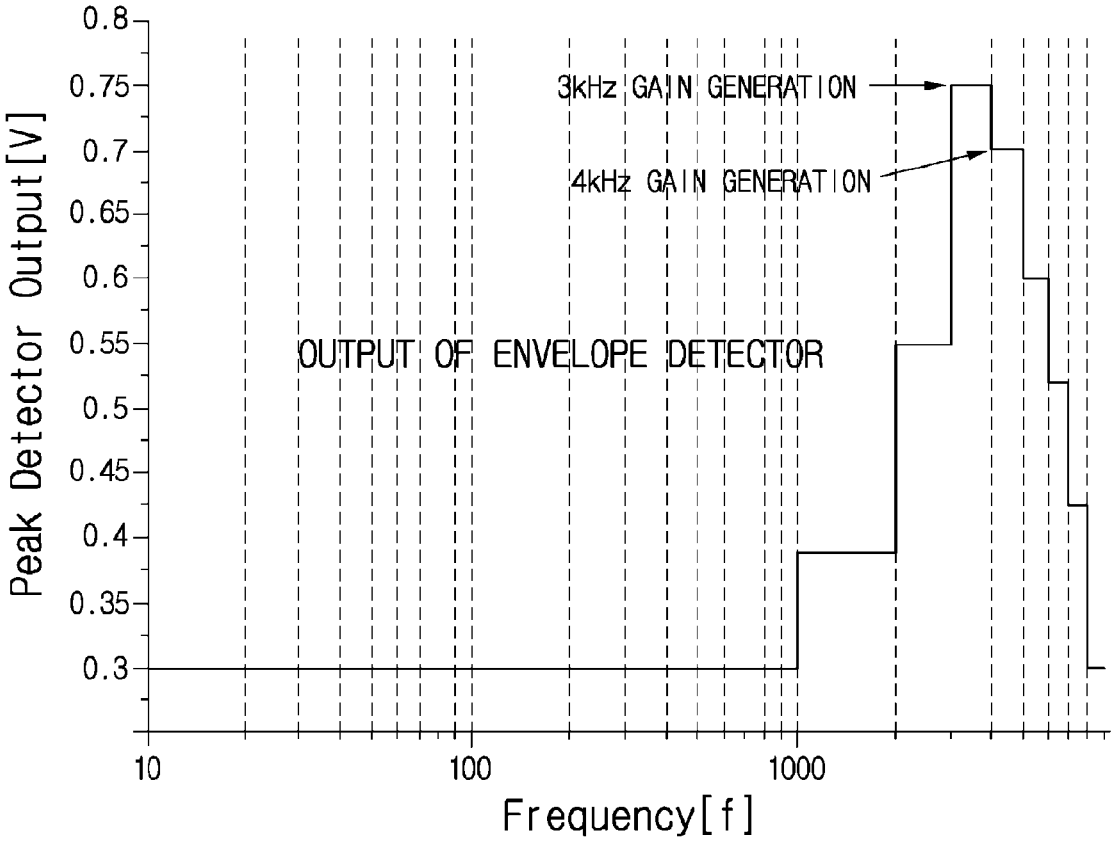

FIG. 4B is a graph showing the output of the envelope detector 101. It can be seen that the output of the external ear canal modeling circuit 100 is indicated at regular intervals of 1 kHz in a range from 1 kHz to 8 kHz.

Figure 4C:
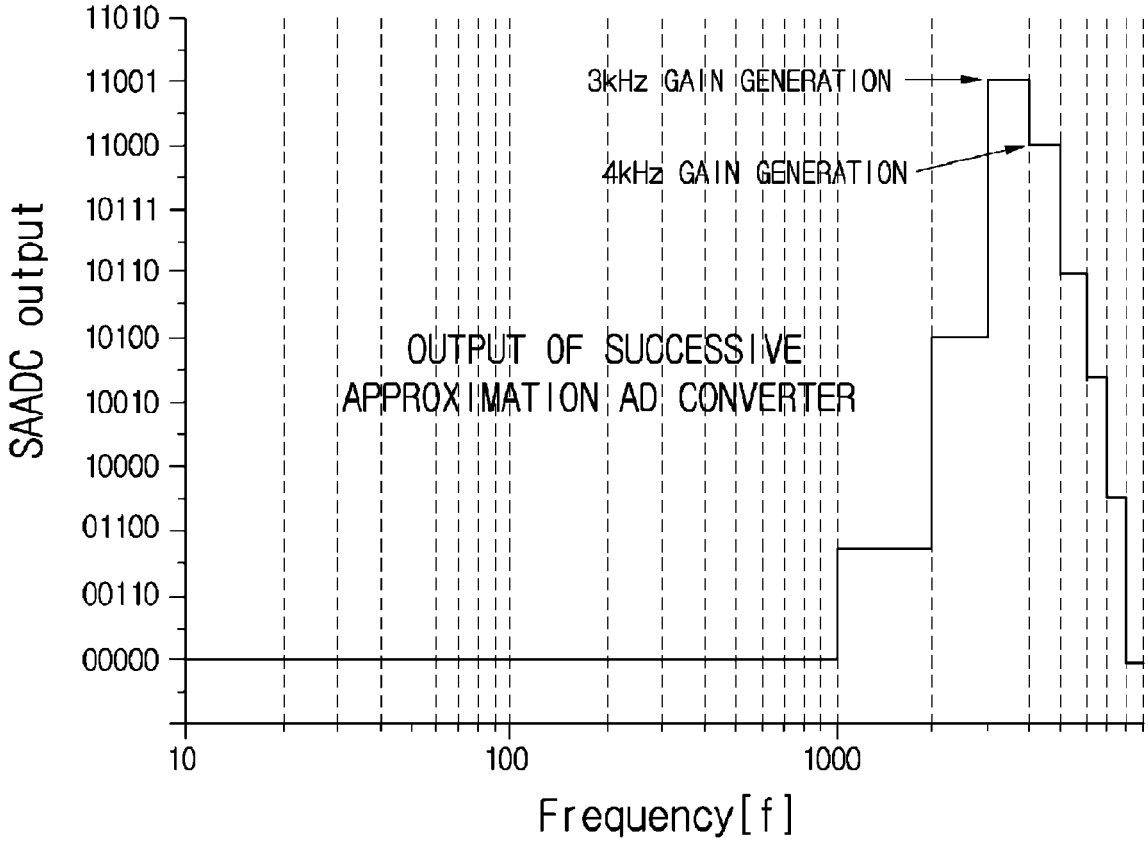

FIG. 4C is a graph showing the output of the successive approximation AD converter 102, measured when signal processing is performed on the output of the envelope detector 101 to obtain gain factors, and the results of signal processing are applied to the successive approximation AD converter 102.

Figure 4D:
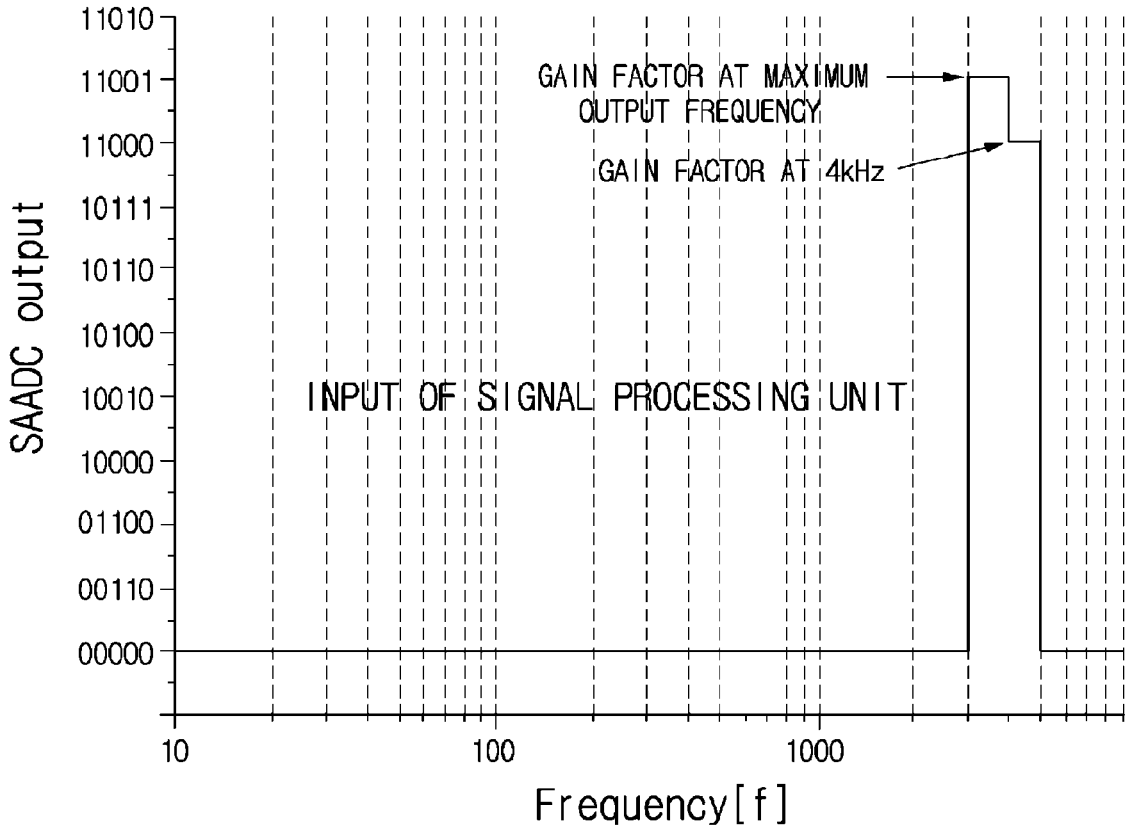

FIG. 4D is a graph showing the gain factor, indicating the gain at 4 kHz, and the maximum gain factor, indicating the maximum gain at frequencies other than 4 kHz, among a plurality of gain factors.

Figure 5A:
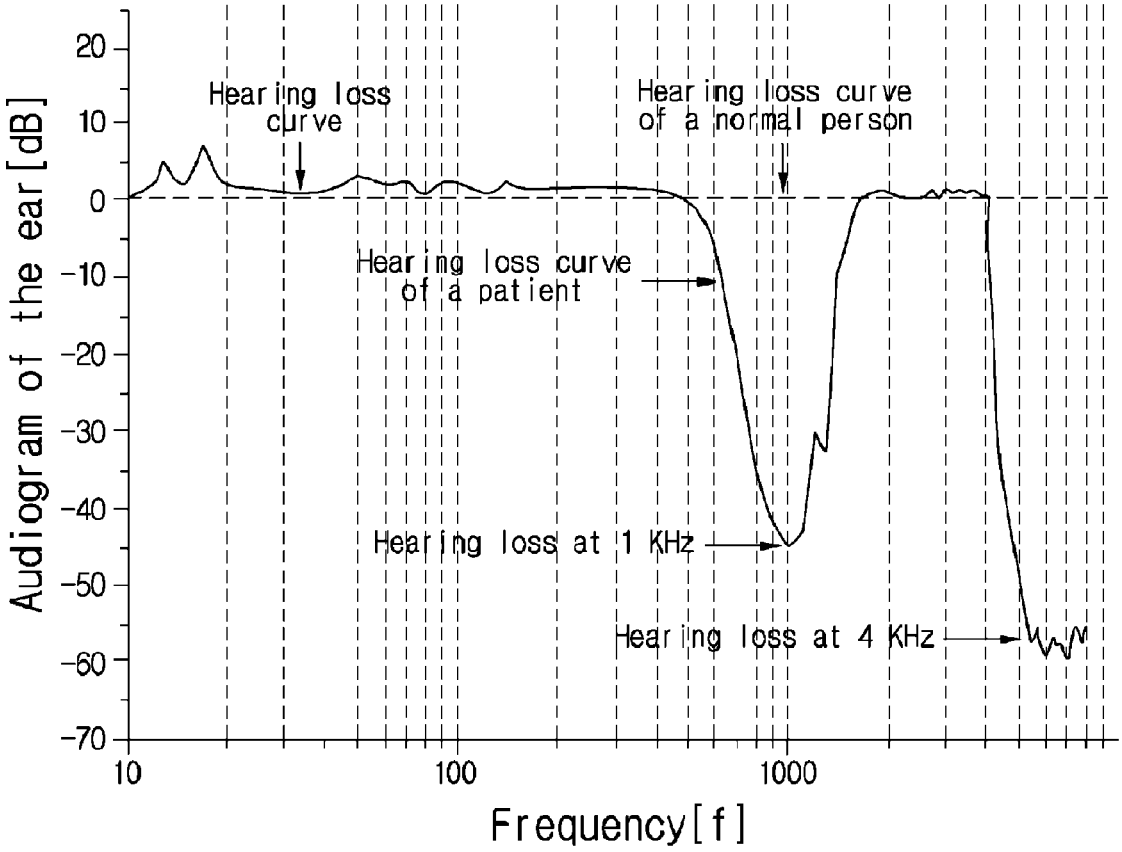
FIGS. 5A to 5C are graphs showing frequency responses obtained using the gain obtainment unit of a digital hearing aid according to the present invention.
Figure 5B:
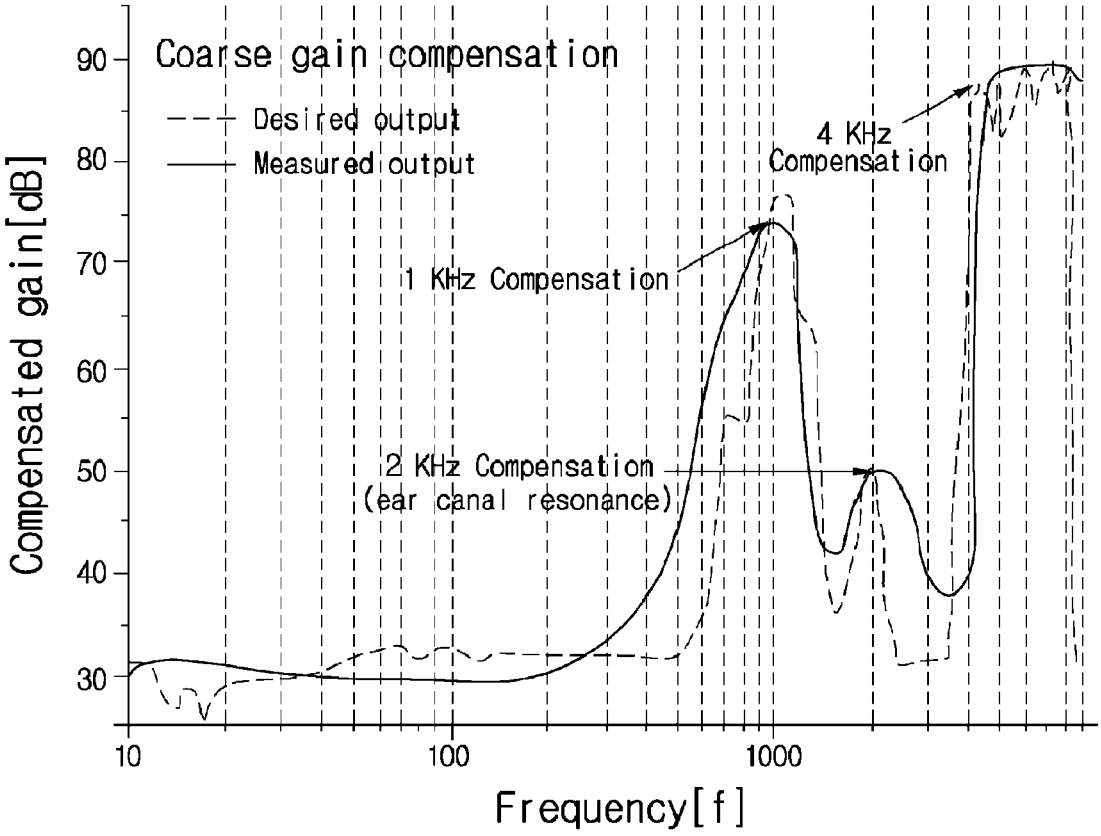
Figure 5C:
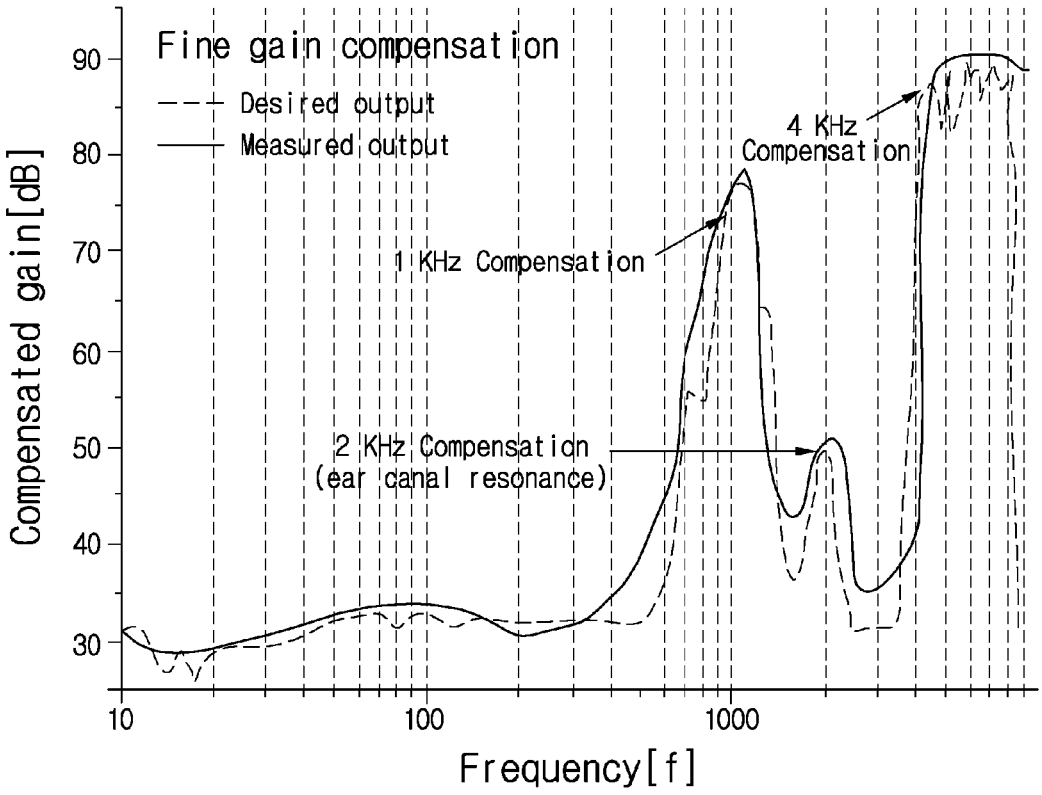

FIGS. 5A to 5C are graphs showing frequency responses obtained using the gain obtainment unit of the digital hearing aid according to the present invention.

That is, FIGS. 5A to 5C illustrate the results of frequency responses measured for a digital hearing aid to which the gain insertion and fitting structure is applied.

In FIG. 5A, a blue solid line indicates the frequency response of a patient who suffers from hearing loss, the frequency response being obtained through a test. It can be seen that hearing loss occurs at frequencies of 1 kHz and 4 kHz. A red dotted line indicates the frequency response for the hearing ability of a normal person, having no hearing loss.

In FIG. 5B, a red dotted line indicates a desired gain, obtained in consideration of a hearing test and the features of the external ear canals, and a blue solid line indicates the gain obtained through the results of primary gain insertion and fitting. In FIG. 5B, it can be seen that hearing loss occurring at 1 kHz and 4 kHz is greatly compensated for, and the resonance gain, occurring due to the characteristic shapes of external ear canals, is compensated for at 2 kHz.

In FIG. 5C, a blue solid line indicates the gain obtained from the results of secondary gain insertion and fitting performed through the hearing test.

As described above, the present invention is advantageous in that it models the structures of external ear canals, the sizes and shape characteristics of which differ between respective persons, captures resonance gains occurring due to the structural characteristics thereof, and performs digitization and signal processing on the resonance gains to allow the resonance gains to be used as gain factors, thus optimizing the performance of the digital hearing aid in consideration of personal features.

Further, the present invention is advantageous in that it performs primary gain insertion and fitting by reducing the time required for gain fitting and possible errors and by optimizing performance for each individual, through gain factors in which both gains generated due to the structural characteristics of external ear canals and gains obtained through individual hearing tests are taken into account, and then performs secondary gain insertion and fitting using gains, obtained by conducting a hearing test again while a hearing aid is being worn, thus further reducing the time required for the gain insertion and fitting of the hearing aid, and realizing gains reflecting the features of different external ear canals of respective persons.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A digital hearing aid, comprising:

an amplification unit for amplifying an external voice signal, input through a microphone;

an Analog/Digital (AD) converter for converting an analog signal, amplified by the amplification unit, into a digital signal;

at least one signal processing unit for performing gain fitting and digital signal processing on the digital signal output from the AD converter;

a Digital/Analog (DA) converter for converting the digital signal, processed by the signal processing unit, into an analog signal;

a receiver driver for outputting the analog signal, output from the DA converter, through a receiver; and a gain obtainment unit for performing gain fitting by utilizing both resonance gains, obtained by an external ear canal modeling circuit implemented according to shape characteristics of structures of external ear canals, and gains, obtained through a hearing test, as gain factors for the signal processing unit wherein the gain obtainment unit comprises:

the external ear canal modeling circuit for modeling the structures of the external ear canals using an LC filter, thus extracting frequency characteristics;

an envelope detector for outputting a DC voltage corresponding to frequency characteristics output from the external ear canal modeling circuit;

a successive approximation AD converter for modulating the DC voltage, output from the envelope detector, into a digital signal;

at least one comparator for generating a control signal required to extract a maximum gain factor at a frequency at which a maximum gain level is obtained, and a gain factor at a specific frequency, from each of an output of the successive approximation AD converter and an output of the hearing test; and an adder for adding a maximum gain factor, output from the successive approximation analog/digital converter, to a maximum gain factor, obtained through the hearing test, in response to the control signal output through the comparator, and outputting a resulting gain factor to the signal processing units.

2. The digital hearing aid according to claim 1, wherein the external ear canal modeling circuit is implemented such that one or more fixed taps, each including an inductor and a capacitor, and one or more variable taps, each including a variable inductor and a variable capacitor, are connected in series, thus adjusting inductance and capacitance of each variable tap in response to an external control signal depending on characteristics of the external ear canals.

3. The digital hearing aid according to claim 2, wherein each of the variable taps comprises four series-connected inductors and four parallel-connected capacitors, which are turned on or off in response to the external control signal, thus enabling a number of inductors and a number of conductors in the variable tap to be adjusted.

4. The digital hearing aid according to claim 1, wherein the external ear canal modeling circuit is implemented such that resonance gains corresponding to frequencies are resonance gains corresponding to responses for pure tones having frequencies increasing in a range from 1 kHz to 8 kHz at regular intervals of 1 kHz.

5. The digital hearing aid according to claim 1, wherein the successive approximation AD converter shuts off power of a multiplexer and a flip-flop at times at which output bits are not output.

6. The digital hearing aid according to claim 1, wherein the gain obtainment unit further comprises a first register unit for storing gain factors output from the successive approximation AD converter.

7. The digital hearing aid according to claim 6, wherein the gain obtainment unit further comprises a second register unit for storing gain factors required to implement a desired gain, obtained through the hearing test.

8. The digital hearing aid according to claim 7, wherein each of the first and second register units comprises a plurality of 5-bit registers, thus enabling the gain factors to be sequentially shifted and stored therein in response to a clock frequency.

9. The digital hearing aid according to claim 1, wherein gain factors obtained through the hearing test are gains obtained at frequencies ranging from 1 kHz to 8 kHz.

10. The digital hearing aid according to claim 1, wherein the specific frequency is a frequency of 4 kHz.

* * * * *